United States Patent [19]

Kuchenbecker

[11] 4,327,833

[45] May 4, 1982

[54] LIQUID TIGHT POURING CARTON

[75] Inventor: Morris W. Kuchenbecker, Neenah, Wis.

[73] Assignee: American Can Company, Greenwich, Conn.

[21] Appl. No.: 101,713

[22] Filed: Dec. 10, 1979

[51] Int. Cl.[3] ..... B65D 5/74

[52] U.S. Cl. ..... 206/621; 206/629; 229/17 R

[58] Field of Search ..... 229/7 R, 17 R, 17 G, 229/3.5 MF, 3.1; 206/605, 608, 611, 620–622, 625, 626, 628, 629

[56] References Cited

U.S. PATENT DOCUMENTS

| | | | |
|---|---|---|---|
| 3,232,514 | 2/1966 | Swede et al. | 229/17 R |
| 3,333,758 | 8/1967 | Buchner | 229/17 R |
| 3,471,991 | 10/1969 | Rausing . | |
| 3,795,359 | 3/1974 | Rausing | 229/17 R X |
| 4,078,715 | 3/1978 | Larsson et al. | 229/17 R |
| 4,248,351 | 2/1981 | Berg | 229/17 R X |

FOREIGN PATENT DOCUMENTS

| | | | |
|---|---|---|---|
| 1296084 | 5/1969 | Fed. Rep. of Germany | 229/7 R |
| 2515849 | 10/1975 | Fed. Rep. of Germany | 229/17 R |
| 1247747 | 10/1960 | France | 229/17 R |
| 861079 | 2/1961 | United Kingdom | 229/7 S |
| 1046424 | 10/1966 | United Kingdom | 229/17 R |

*Primary Examiner*—Stephen Marcus

*Attorney, Agent, or Firm*—Robert P. Auber; Thomas D. Wilhelm

[57] ABSTRACT

A liquid tight pouring carton is provided, having a pour spout which is easily opened by removal of a tear tab, and can be fully extended thereafter. The tear tab is provided as part of a sealed fin on the top of the carton; the tear tab having a line of weakness extending through the paperboard, but not into or through the barrier and sealing layers of foil and plastic. Until the tab is removed, the carton is completely sealed to leakage or contamination.

The invention also contemplates a blank suitable for erection into the carton, and a method of making the blank and erecting and sealing it.

24 Claims, 11 Drawing Figures

FIG. 1
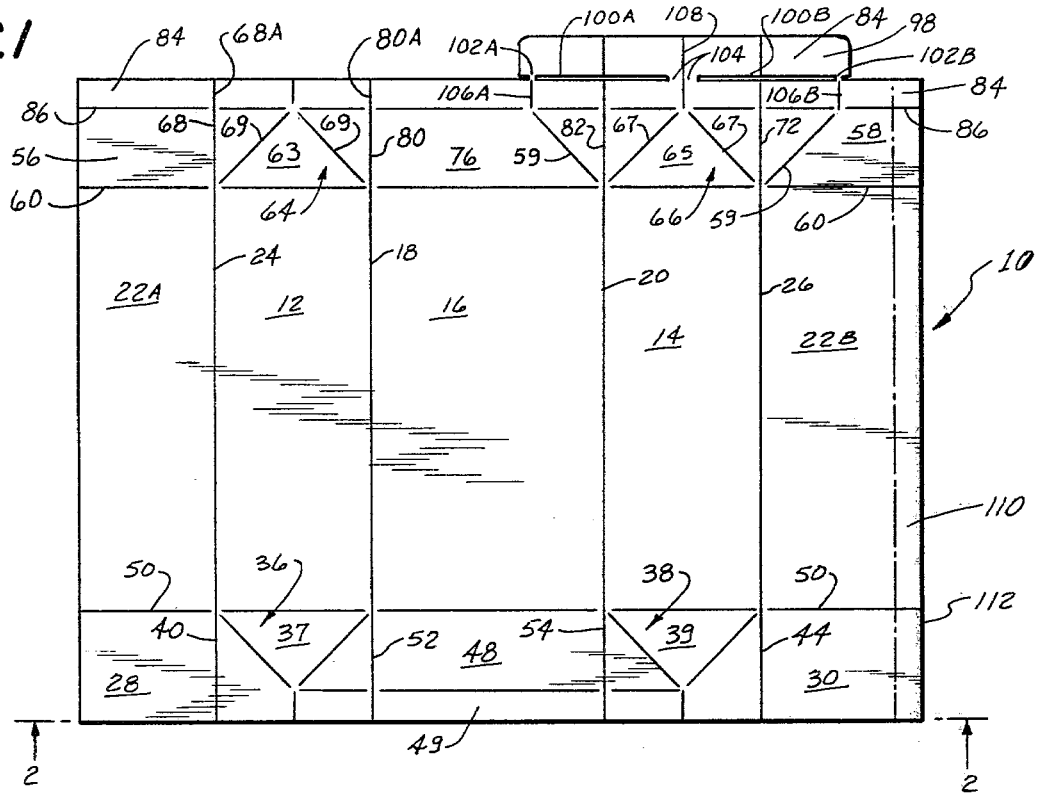
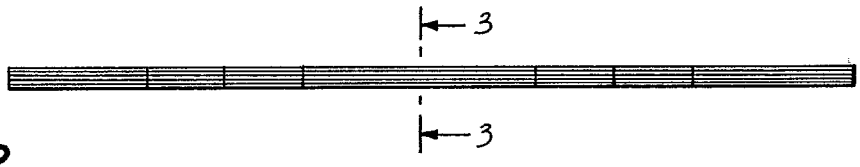
FIG. 2
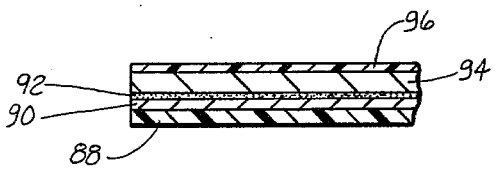
FIG. 3

FIG. 4
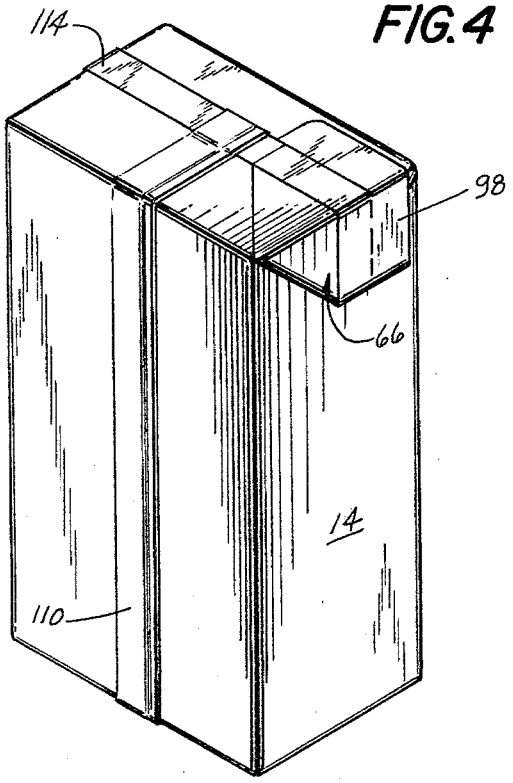
FIG. 5
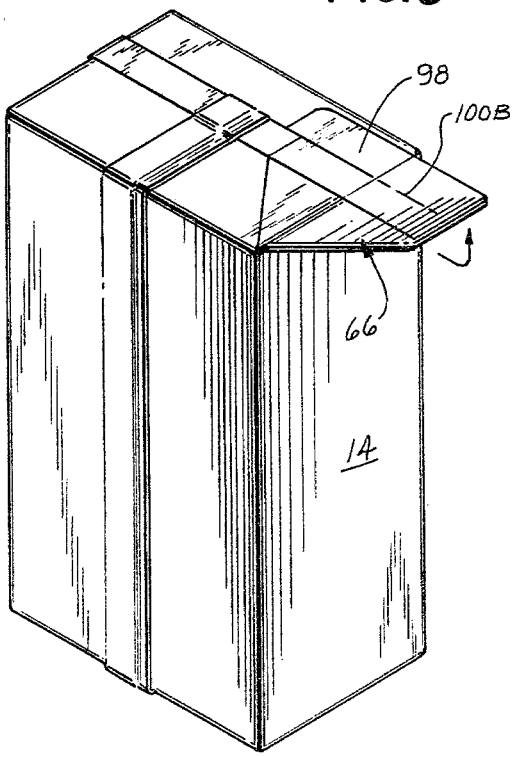
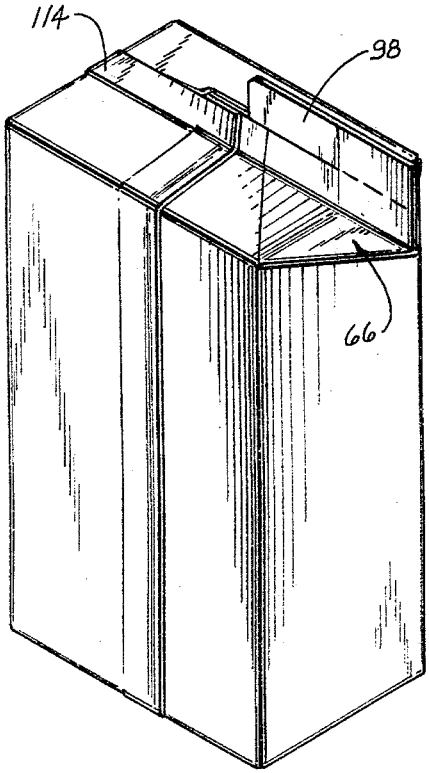
FIG. 6

LIQUID TIGHT POURING CARTON

BACKGROUND OF THE INVENTION

This invention pertains to the technology of cartons generally formed of paperboard and capable of holding liquid products. Typical cartons have a core structural layer of paperboard providing the carton's strength and rigidity. A layer of aluminum foil is adhered to one surface of the paperboard and serves as a barrier layer against passage of contaminants into the package. Both outer surfaces of the paperboard/foil combination are then coated with heat sealable plastic. While a number of specific constructions are known, it is generally accepted practice to close the carton openings with seals wherein surfaces of the plastic which faces the interior of the carton are brought into face-to-face contact along opposing edges and sealed together, in most cases forming a fin. A typical carton is produced as Systempak, by Papeteries de Belgique in Belgium. A similar carton is produced by Tetra-Pak in Lund, Sweden. German Pat. No. 2,721,390 describes another similar carton wherein part of the paperboard is removed from one side of a longitudinal seam to reduce the possibility of product leakage from the carton bottom.

In all of the liquid holding cartons of the prior art, access to the product is obtained by cutting open the fin seal on the top of the carton and cutting away a portion of the spout. All of the above-mentioned cartons suggest the use of scissors. While the use of scissors is certainly functional, it is inconvenient, and it is not always practical to have a pair of scissors available. Thus, the use of existing cartons is limited by the immediate availability of some means of cutting open the carton.

It is therefore an object of this invention to provide a liquid-tight pouring carton which can be opened without the use of a mechanical cutting device.

It is a further object of this invention to provide such a carton having a complete spout, which maximizes the ease of pouring.

It is a particular object to provide an opening means which can be activated to open the carton by tearing the opening means on a predetermined and weakened line, the carton being fully sealed and capable of holding liquid until the opening means is activated.

Also contemplated is a blank suitable for erection into the liquid-tight carton of this invention.

A particular object is to provide a method of making the blank, and subsequently forming it into the carton.

SUMMARY OF THE INVENTION

It has now been found that certain of the foregoing and related objects of the invention are readily attained in a novel liquid tight carton, and a carton blank, constructed from a structural carton material, and having a heat sealable layer on the inner surface thereof, the carton comprising a bottom wall, upstanding side walls and upstanding end walls, the side walls and end walls connected to the edges of the bottom wall and to each other to form a receptable; and a top wall connected to the side walls and the end walls. The top wall is comprised of extensions of the side walls and the end walls, the extensions being joined together and comprising main extension panels joined to the side walls and the end walls, and sealing margins on the edge of each extension remote from the side walls and the end walls, the sealing margins being joined together in the form of a fin seal, producing a fin having multiple thicknesses of the structural carton material joined together on the top of the carton. The seal has an outer edge disposed toward the outer edge of the fin and an inner edge disposed toward the interior of the carton. Each thickness of structural carton material has a structural line of weakness substantially on the inner edge of the seal and extending along the fin from substantially one end thereof to a point short of the other end of the fin, the structural lines of weakness being disposed within the structural carton material. Thus, the heat sealable layer is devoid of the structural lines of weakness and serves as an effective barrier against leakage of product which may be contained in the carton. The structural lines of weakness on opposing thicknesses of carton material are in substantial registry with one another, forming an easily removable section of the top panel.

In a preferred embodiment, the margins comprising the fin have tab extensions connected thereto on the one end of the fin, the structural line of weakness on each thickness of structural carton material being disposed between the tab extensions and the remainder of the margin, the tab extensions being joined to each other, and comprising the easily removable section of the top panel. The top of the carton has a substantially continuous seal along the entire length thereof, the seal extending continuously from the tab onto the sealing margin spaced away from the tab and the one end of the fin.

An especially preferred embodiment includes a layer of metal foil interposed between, and firmly adherent to, the structural carton material and the heat sealable layer, the metal foil and the heat sealable layer comprising an inner lining in the carton, the lining being devoid of the structural lines of weakness.

While the structural line of weakness may have a variety of constructions, the preferred construction comprises a substantially continuous cut line through the structural carton material, the lining being unbroken and unweakened in the area of the cut line.

In a most preferred embodiment, the carton is adapted for pouring a liquid, and the top wall has a pour spout on the end thereof corresponding to the one end of the fin, the pour spout being comprised of a series of gussets. The combination of the pour spout and the removable section is cooperatively disposed so that, upon removal of the removable section, the spout may be opened for dispensing product. The pour spout may include a foldable line extending from the pouring tip of the pour spout downwardly through the center of the corresponding extension and onto the corresponding end wall. In an especially preferred embodiment of the spout construction, the structural line of weakness includes a small, uncut, and substantially unweakened, segment of carton material at the one end of the fin where the pouring tip is to be formed when the carton is opened, such that, when the easily removable section is removed, allowing the carton to be opened, the tearing away of the unweakened segment leaves a ragged tit on the top of the pouring spout.

In an advantageous assembly of the carton, the fin is folded against the top wall and the ends of the top wall are folded down against the corresponding end walls and secured to them.

In order for the carton to be most advantageously opened, at least one sealing margin may have a line of weakness extending from the outer edge of the margin to the edge of the main body of the adjoining extensions, the lines of weakness being located adjacent the joinder between the end wall extension opposite the one end and the adjoining side wall extensions. This provides for relief of the stresses imposed on the top fin when the fin is erected for carton opening.

The invention also contemplates a cut and scored carton blank suitable for erection into the carton of this invention.

The invention further contemplates a method of forming the carton of this invention, the method including, in order, the steps of forming the lines of weakness on the structural carton material; adhering a heat sealable layer of liquid-impervious material to the predetermined inner surface of the structural carton material, and over the formed line of weakness; scoring the composite carton material structure, and cutting the carton blank from the sheet; and erecting, folding and sealing the carton. The method also contemplates the heat sealable layer being adhered to the entire inner surface of the structural carton material. Preferrably, the heat sealable layer is extrusion coated onto the structural carton material.

In an especially preferred method, the steps include forming the line of weakness and substantially simultaneously printing the material on its outer surface; laminating a sheet of metal foil to the inner surface of the carton material, and extrusion coating a plastic onto the outer paperboard surface and the exposed inner surface of the foil, the extrusion coating on the inner surface of the foil being of a thickness effective for heat sealing the carton members to each other in face-to-face seals between coated inner surfaces; scoring the composite carton material structure and cutting the carton blank from the sheet; and erecting, folding and sealing the carton.

The preferred method of folding and sealing the carton comprises the steps of forming a fin seal on the top of the carton, folding the fin against the top wall, and folding down and securing the ends of the top wall against the corresponding end walls.

BRIEF DESCRIPTION OF THE DRAWINGS

FIG. 1 is a plan view of a blank for making the package of this invention.

FIG. 2 is an edge view of the blank of FIG. 1, showing the layers responsible for the package function.

FIG. 3 is an enlarged fragment of the edge view taken at 3—3 of FIG. 2, and showing, in detail, all the layers in the composite structure of the blank material, in reverse order.

FIG. 4 is a perspective view of the erected and closed carton.

FIG. 5 is a perspective view of the carton with the end of the spout and tab partially erected for opening.

FIG. 6 is a perspective view of the carton with the spout and tab fully erected and ready for opening.

DETAILED DESCRIPTION OF THE PREFERRED EMBODIMENTS

Figure 7:
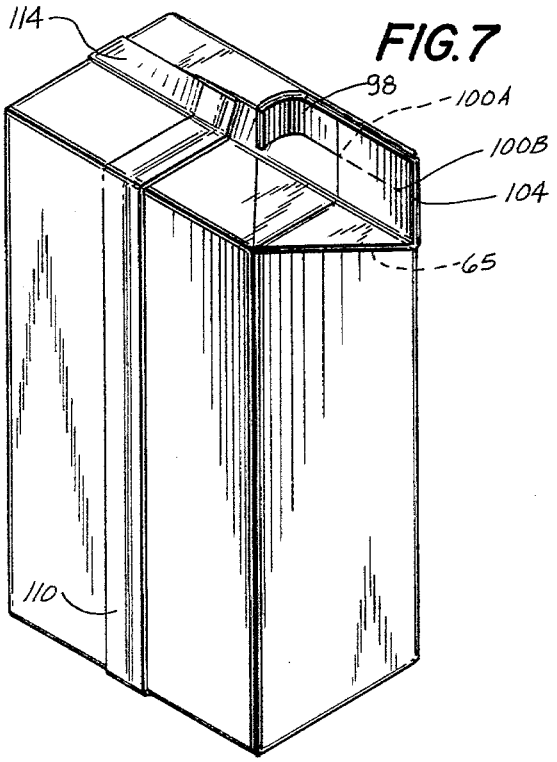
FIG. 7 is a perspective view of the carton showing the tab partially torn off.

A liquid-tight pouring carton is formed from a flat blank such as that shown in FIG. 1 and generally designated as 10. As shown in FIG. 2, the blank is generally a five layer structure including paperboard, aluminum foil, and heat sealable plastic. Paperboard provides the general structural strength and rigidity, and serves as the structural carton material. Aluminum foil serves as a barrier protecting the contents from contamination by the external environment. The heat sealable plastic forms a continuous seal in the formed carton to effectively contain liquid product. As shown in greater detail in FIG. 3, the blank is composed, from the inside layer toward the outside, of a heat sealable plastic 88 adhered to a layer of aluminum foil 90 which is adhesively mounted on its opposing surface, by means of adhesive 92 to paperboard 94. The paperboard is coated on its outside surface by a layer of polyethylene 96. Now reviewing the structure and its manufacture in detail—the blank has two end walls 12 and 14, and a side wall 16 interposed between end walls 12 and 14 and connected therebetween by hinge lines 18 and 20. Side wall panels 22A and 22B are connected to the opposite sides of end walls 12 and 14 respectively by hinge lines 24 and 26.

Bottom wall panels 28, 30, 36, 38, and 48 are extensions of side wall panels 22A and 22B and end and side walls 12, 14, and 16, and are connected thereto by hinge line 50. Bottom wall panels 36 and 38 include triangular panels 37 and 39 respectively and sealing margins. Panel 36 is connected to panel 28 by hinge line 40. Panel 38 is connected to panel 30 by hinge line 44. Panel 48 has a sealing margin 49, which extends onto panels 36 and 38, and is connected to panel 36 by hinge line 52 and to panel 38 by hinge line 54.

Top wall panels 56, 58, 64, 66, and 76 are extensions of side wall panels 22A and 22B, and end side walls 12, 14 and 16; and are connected thereto by hinge line 60. Top wall panels 64 and 66 include triangular panels 63 and 65, and are extensions of end walls 12 and 14. Panel 64 is connected to panel 56 by hinge line 68. Panel 66 is connected to panel 58 by hinge line 72. Top wall panel 76 is connected to panel 64 by hinge line 80 and to panel 66 by hinge line 82. Panels 56, 58, 64, 66 and 76 have included therein a sealing margin 84 bounded generally by crease line 86 and extending to the outer edge of the blank. Panels 58 and 76 have hinge lines 59 extending diagonally thereacross from crease line 86 to hinge line 60.

Hinge lines 68A and 80A, extending from hinge line 86 to the outer edge of the blank have perforations through the paperboard 94, thus weakening hinge lines 68A and 80A. The foil 92 and heat seal plastic 88 are not perforated, thus preserving the integrity of the barrier and seal layers.

Sealing margin 84 includes a tab extension 98 on that portion of the sealing margin comprising panels 58, 66, and 76. It is intended that tab extension 98 be considered part of sealing margin 84 wherever it is used; and the tab extension will hereinafter be referred to as a tab.

Cut lines 100A and 100B extend across the sealing margin 84 generally forming the boundary between tab 98 and the remainder of the sealing margin. Significantly, cut lines 100A and 100B extend through the paperboard layer 94, but do not extend into or through the metal foil and heat sealing layers 90 and 88. Thus the barrier and sealing properties provided by layers 90 and 88 are preserved in the area of cuts 100A and 100B. The cuts may or may not extend through layer 96, depending on the method of construction. Small reinforcing nicks 102A and 102B in cut lines 100A and 100B provide sufficient structural strength to prevent inadvertent initiation of tearing along lines 100A and 100B and removal of tab 98. Between the facing ends of cut lines 100A and 100B is an uncut area 104. In a typical one liter carton, the uncut distance between the ends of lines 100A and 100B is about 12 millimeters. Hinge lines 106A and 106B extend from the intersection of hinge lines 59 and 86 across sealing margins 84 to nicks 102A and 102B respectively. Hinge line 108 extends from the intersection of hinge lines 67 and 86 across sealing margin 84 to the outer edge of the blank.

In the preferred method of making the blank, a roll of paperboard is first die cut, making perforations 68A and 80A and cut lines 100A and 100B. If desired, the paperboard may be printed in the same operation. A layer of aluminum foil is then extrusion laminated with polyethylene to the surface of the paperboard which will face the interior of the carton. Typically, the foil is 0.00030 to 0.00035 inches thick. At this point, the composite structure includes the paperboard 94 and the foil 90 on its outer surfaces, and plastic 92 between layers 90 and 94, as the adhesive. The foil surface is then extrusion coated with the heat sealable layer 88, and the paperboard surface is extrusion coated with polyethylene. In the final step of making the blank, the hinge lines are all formed by crease scores and the blank is cut from the continuous rolls.

EXAMPLE 1

Paperboard having a weight of 150 pounds per 3000 square foot ream and 13 mils thickness in roll form was unwound, printed, and cut, forming lines 100A and 100B and perforation lines 68A and 80A, and wound up. Aluminum foil 0.00035 inch thick was then extrusion laminated to the surface of the paperboard predetermined to be on the inside of the carton using $\frac{3}{4}$ mil of low density polyethylene and rewound. The foil surface was then extrusion coated with $2\frac{1}{4}$ mils of Surlyn, an ionomer sold by the duPont Company. The paperboard surface was then extrusion coated with $\frac{3}{4}$ mil of low density polyethylene. Finally, the crease scores were formed and the finished blank was cut from the roll.

EXAMPLE 2

In an alternate method, the surface of the paperboard predetermined to be on the outside of the carton was first extrusion coated with $\frac{3}{4}$ mil low density polyethylene. It was then printed and cut, forming lines 100A and 100B and perforation lines 68A and 80A, the cuts penetrating both the paperboard and the polyethylene. The aluminum foil was then extrusion laminated to the inside surface of the paperboard, and the foil was extrusion coated with Surlyn, as in EXAMPLE 1. Finally the scores were formed and the blanks cut from the roll.

Since the heat seal layer 88 and the foil layer 90 are both mounted to the paperboard after formation of cuts 100A and 100B, and perforations 68A and 80A, layers 88 and 90 form unitary and unbroken layers between the paperboard cuts and any product in the package, thus ensuring that the seal and barrier layers function as intended. Conversely, the paperboard is weakened by the cuts and perforations, such that the structure can be torn at those locations at the appropriate time. In the case of EXAMPLE 2, the outside layer 96 is also cut, making tears easier to effect at the appropriate time. Wherever layer 96 is cut in forming lines 68A, 80A and 100A and 100B, layer 96 is to be considered as part of the structural carton material. When layer 96 is cut, the tear strength required to remove tab 98 is less than when layer 96 is not cut. It follows that tab 98 is also more susceptible to damage from abuse when layer 96 is cut. The option of cutting layer 96 thus provides additional freedom in designing the remainder of the carton around the requirements of secure sealing and easy opening.

As shown in FIG. 1, the surface of the blank facing the viewer is heat seal layer 88. The first step of forming the carton is the formation of the side seam 110. Side wall panel 22B and its extensions 30 and 58 are rotated about hinge line 26, folding the heat sealable surface 88 against itself. Edge 112 of panel 22B (and its extensions) is then foled outwardly to present the heat sealable surface of the edge 112 facing upwardly. Excess material may be skived from the paperboard layer 94 and plastic layer 96 removed, in order to facilitate seam seal formation. Panels 12 and 22A, and their extensions, are then rotated about hinge line 18 and folded over into facing relationship with the edge 112 of panel 22B. Heat is applied and the facing surfaces are sealed together forming side seam seal 110.

Figure 10:
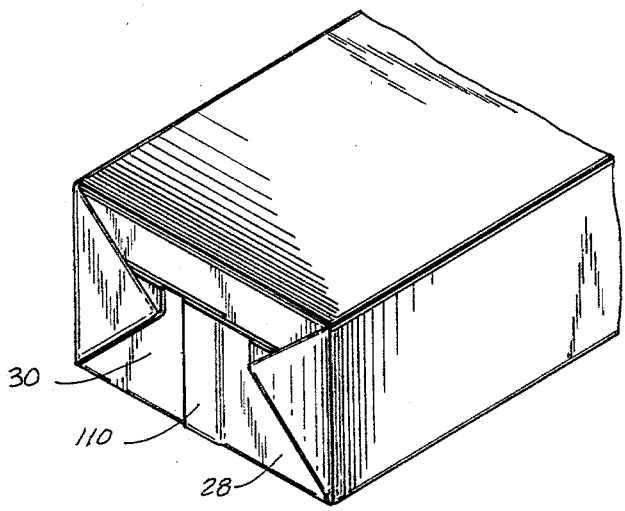
FIG. 10 is a fragmentary view showing the bottom construction of the fully erected carton.

The carton is then erected into tubular form. Panel 48 and combined panels 28 and 30 are then rotated inwardly about hinge line 50. Simultaneously, panels 37 and 39 are folded outwardly about hinge line 50, drawing the remainder of panels 36 and 38 inwardly along with panels 48, 28 and 30. Pressing and embossing tools, not shown, are put in place, and the facing heat sealable edges are then heated and sealed together in a modified fin seal. End panels 36 and 38 are then rotated about hinge line 50 and adhered to the exterior surfaces of panels 28 and 30. The completely finished bottom is as shown in FIG. 10. While a typical bottom formation has been disclosed, its structure is not critical, and other structures are acceptable so long as they form liquid-tight seals.

The top of the carton is formed by making a fin seal along seal margin 84. To this end, top wall panels 76 and the combination of panels 56 and 58 are folded inwardly about hinge line 60 and the respective portions of sealing margin 84, including tab 98, are brought into face-to-face relationship. Simultaneously panels 63 and 65 are rotated outwardly about their respective hinge lines 60 and fold about lines 67 and 69, drawing the remainder of panels 64 and 66 inwardly along with panels 76, 56, and 58. Thus panels 76, 56, 58, and portions of panels 64 and 66 adjacent hinge lines 68, 72, 80 and 82 are generally formed into a common surface as the top wall of the carton. Sealing margin 84 is then heat sealed to itself, forming an upstanding fin extending the full length of the carton and completely sealing it. In the process of sealing margin 84 to itself, heat seals are preferentially made on tab 98 between the line of cut lines 100A and 100B and the outer edge of tab 98. In general, the portion of seal margin 84 between the line of cut lines 100A and 100B and hinge line 86 is not heat sealed to itself. Moreover, it is important that these facing heat sealable surfaces remain unsealed. The seal includes tab 98 and all of seal margin 84 except that located between tab 98 and hinge line 86. Notwithstanding the above, a continuous heat seal is effected between tab 98 and the remainder of the sealed area of seal margin 84 through the general area of nicks 102A and 102B, in order to completely seal the top wall of the carton. The sealed fin 114 is then folded against the top wall, and away from side seam 110. Panels 64 and 66 are then folded against end walls 12 and 14 respectively and adhered thereto, completing the construction of the package, as shown in FIG. 4.

Figure 8:
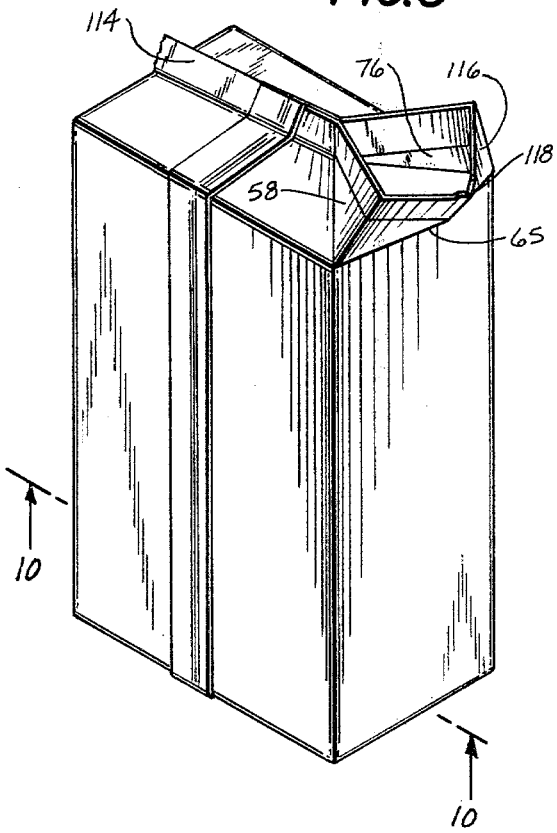
FIG. 8 is a perspective view showing the tab removed and the spout open.

In opening and using the package, panel 66 is released from panel 14 as shown in FIG. 5 and tab 98 is erected as shown in FIG. 6. If desired, the perforations at 68A and 80A may be broken as shown in FIG. 8. Tab 98 is removed from the carton by tearing it along cut lines 100A and 100B as shown in FIG. 7. Since care was taken to not heat seal together that portion of seal margin 84 underlying tab 98 the top wall is then unsealed directly below the remaining edges of cut lines 100A and 100B. Thus, upward pressure on triangular panel 65 is effective to open panel 66 and adjoining portions of panels 58 and 76 into a pour spout 116 as shown in FIG. 8.

Figure 11:
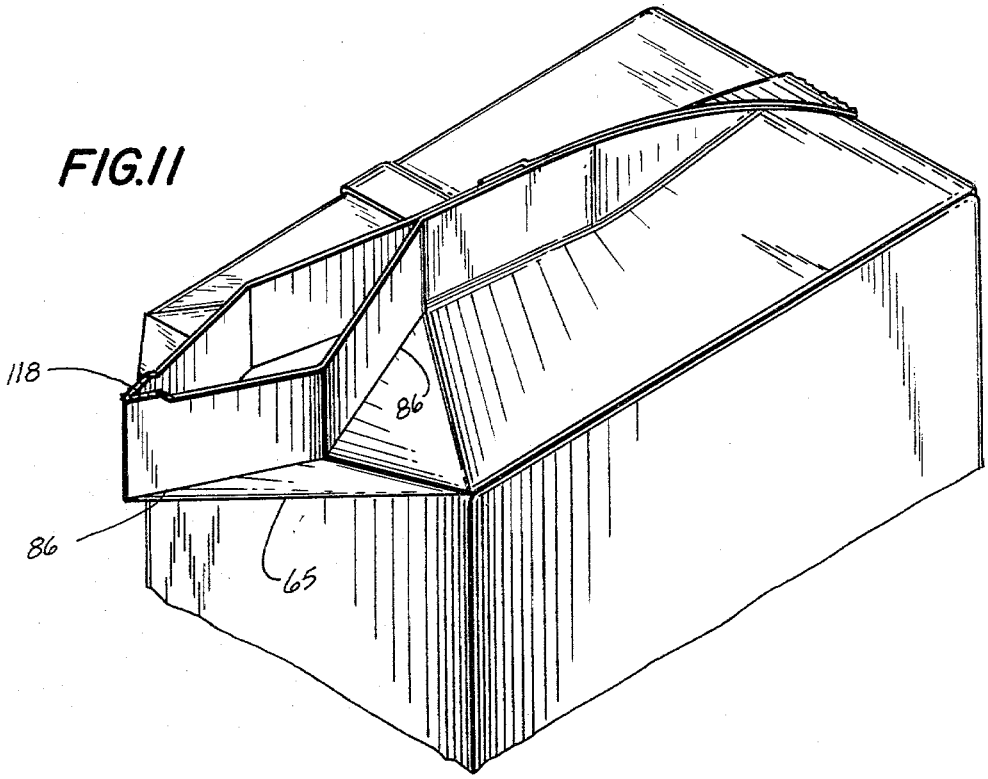
FIG. 11 is an enlarged view of the top of the carton showing the tit on the tip of the opened spout.

In removing tab 98 it is significant that cut lines 100A and 100B terminate short of what will be the tip of the pour spout 116. Thus, as the tab is removed, and the tear reaches the ends of the cut lines, complete removal of the tab requires tearing of the paperboard in uncut area 104. This tearing of the paperboard leaves fibers protruding in an extended tit 118 projecting slightly above the general line of cut lines 100A and 100B, shown graphically in FIG. 11. It has been observed that, for pouring liquid slowly from a full carton, the presence of tit 118 substantially reduces the tendency of the liquid to cling to the carton and dribble down along end wall 14. While tit 118 enhances the operation of pour spout 116, and substantially improves its performance, the functioning of pour spout 116 is entirely satisfactory without tit 118 for most uses.

Figure 9:
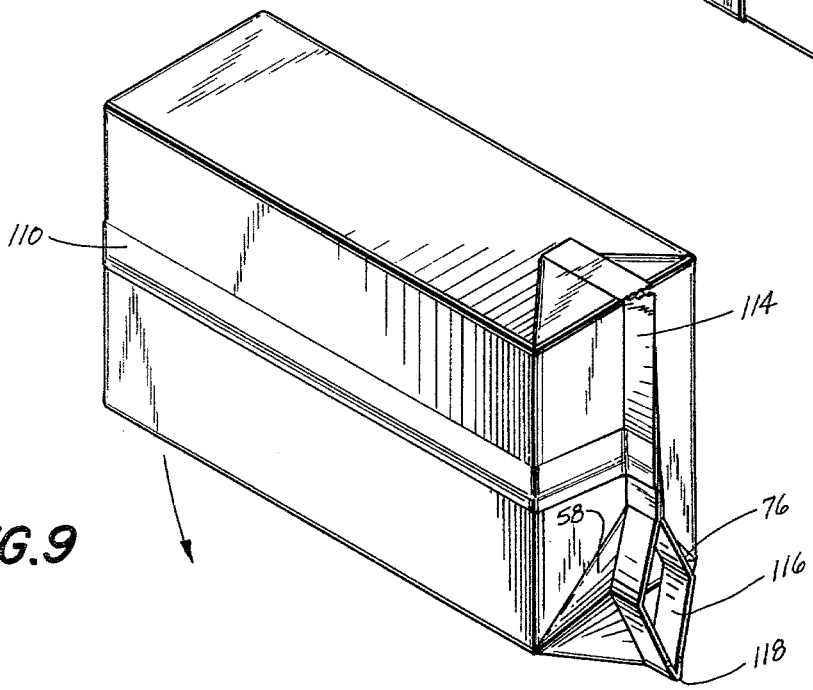
FIG. 9 shows the carton in a tipped pouring position with the spout open.

While lines 68A and 80A have been described as lines of perforation useful to facilitate the tearing and standing up of the fin 114 when the carton is opened, and while other means of weakening lines 68A and 80A are acceptable, in some embodiments lines 68A and 80A may more desirably be crease scores, in order to maximize strength at the respective carton corner. In those embodiments, lines 68A and 80A may still be readily torn, in the same manner as shown in FIGS. 8 and 9. Lines 100A and 100B have been described herein as cut lines through paperboard layer 94, and, in some embodiments, also through layer 96. While cut lines are preferred, other means of weakening lines 100A and 100B are contemplated, such means as cut scores and perforations.

Thus it is seen that this invention provides a liquid-tight pouring carton which can be opened without the use of any mechanical cutting device. An opening means is provided which can be activated to open the carton by tearing the opening means on a predetermined and weakened line, and the opened carton has a complete spout which maximizes the ease of pouring. Before the carton is opened, it is fully sealed and capable of holding liquid until the opening means is activated.

The invention also provides a blank suitable for erection into the carton; and provides a method of making the blank, and subsequently forming it into the carton.

Having thus described the invention, what is claimed is:

1. A liquid tight carton constructed from a structural carton material, and having a heat sealable layer on the inner surface thereof, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension remote from said side walls and said end walls; said sealing margins being joined together in the form of a fin seal, producing a fin having multiple thicknesses of said structural carton material joined together on the top of said carton, said seal having an outer edge disposed toward the outer edge of said fin and an inner edge disposed toward the interior of said carton; each said thickness of structural carton material having a structural line of weakness substantially on said inner edge of said seal and extending along said fin from substantially one end thereof to a point short of the other end of said fin, said structural lines of weakness being disposed within said structural carton material; said heat sealable layer being devoid of said structural lines of weakness and serving as an effective barrier against leakage of product which may be contained in said carton; said structural lines of weakness on opposing thicknesses of carton material being in substantial registry with one another, forming an easily removable section of the wall, wherein said margins comprising said fin have a tab connected thereto on said one end of said fin; said structural line of weakness on each said thickness of structural carton material being disposed between said tab and said margin, said tabs being joined to each other, and comprising said easily removable section of the top wall; said sealing margins on said one end of said fin being substantially free of seals between one another; the top of said carton having a substantially continuous seal along the entire length thereof.

2. A carton as in claim 1, said carton comprising a layer of metal foil interposed between, and being firmly adherent to, said structural carton material and said heat sealable layer, said metal foil and said heat sealable layer comprising an inner lining in said carton, said lining being devoid of said structural lines of weakness.

3. A carton as in claim 2 wherein said structural line of weakness comprises a substantially continuous cut line through said structural carton material, said lining being unbroken and unweakened in the area of said cut line.

4. A carton as in claim 2 wherein said top wall has a pour spout on the end thereof corresponding to said one end of said carton, the combination of said pour spout and said removable section being cooperatively disposed so that, upon removal of said removable section, said spout may be opened for dispensing product.

5. A carton as in claim 4 wherein said fin is folded against said top wall and wherein the ends of said top wall are folded down against the corresponding end walls and secured thereto.

6. A carton as in claim 4 wherein said line of weakness comprises a substantially continuous cut line through said carton material, said lining being unbroken in the area of said cut line.

7. A carton as in claim 4 wherein said structural line of weakness includes a small, uncut, and substantially unweakened, segment of carton material at said one end of said fin where said pouring tip is to be formed when the carton is opened, such that, when said easily removable section is removed, opening said carton, the tearing away of said unweakened segment leaves a ragged tit on the tip of the pouring spout.

8. A carton as in claim 7 wherein said fin is folded against said top wall and wherein the ends of said top wall are folded down against the corresponding end walls and secured thereto.

9. A carton as in claim 1, said sealing margin including a line of weakness extending from the outer edge of said margin to the edge of the main extension panels, said line of weakness being located adjacent the joinder between the end wall extension opposite said one end and the adjoining side wall extensions.

10. A cut and scored carton blank being constructed from a structural carton material having a heat sealable layer on the surface thereof which will be on the interior of the carton, said blank being susceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each of said extension remote from said side walls and said end walls; said sealing margins being joined together in the form of a fin seal, producing a fin having multiple thickness of said structural carton material joined together on the top of said carton, said seal having an outer edge disposed toward the outer edge of said fin and an inner edge disposed toward the interior of said carton; each said thickness of structural carton material having a structural line of weakness substantially on said inner edge of said seal and extending along said fin from substantially one end thereof to a point short of the other end of said fin, said structural lines of weakness being disposed within said structural carton material; said heat sealable layer being devoid of said structural lines of weakness and serving as an effective barrier against leakage of product which may be contained in said carton, said structural lines of weakness on opposing thicknesses of carton material being in substantial registry with one another, forming an easily removable section of the top panel, wherein said margins comprising said fin have a tab connected thereto on said one end of said fin; said structural line of weakness on each said thickness of structural carton material being disposed between said tab and said margin, said tabs being joined to each other, and comprising said easily removable section of the top panel; said sealing margins on said one end of said fin being substantially free of seals between one another, the top of said carton having a substantially continuous seal along the entire length thereof.

11. A carton blank as in claim 10, said blank comprising a layer of metal foil interposed between, and being firmly adhered to, said structural carton material and said heat sealable layer, said metal foil and said heat sealable layer comprising an inner lining in said erected carton, said lining being devoid of said structural lines of weakness.

12. A carton blank as in claim 11 wherein said structural line of weakness comprises a substantially continuous cut line through said structural carton material, said lining being unbroken in the area of said cut line.

13. A carton blank as in claim 11 wherein said top wall has a pour spout on the end thereof corresponding to said one end of said carton, the combination of said pour spout and said removable section being cooperatively disposed so that, upon removal of said removable section, said spout may be opened for dispensing product.

14. A carton blank as in claim 13 wherein said structural line of weakness includes a small, uncut, and substantially unweakened, segment of carton material at said one end of said fin where said pouring tip is to be formed when the carton is opened, such that, when said easily removable section is removed, opening the carton, the tearing away of said unweakened segment leaves a ragged tit on the tip of the pouring spout.

15. A carton blank as in claim 13 wherein said line of weakness comprises a substantially continuous cut line through said carton material, said lining being unbroken in the area of said cut line.

16. A carton blank as in claim 10, said sealing margin including a line of weakness extending from the outer edge of said margin to the edge of the main body of the adjoining extensions, said line of weakness being located adjacent the joinder between the end wall extension opposite said one end and the adjoining side wall extensions.

17. A liquid tight carton constructed from a structural carton material, and having a heat sealable layer on the inner surface thereof, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension panel remote from said side walls and said end walls; said sealing margins being joined together in the form of a fin seal, producing a fin having multiple thicknesses of said structural carton material joined together on the top of said carton, said seal having an outer edge disposed toward the outer edge of said fin and an inner edge disposed toward the interior of said carton, said carton top having one end and said fin having a corresponding end for disposition of opening means thereon; each said thickness of structural carton material having a structural line of weakness substantially on said inner edge of said seal and extending along said fin from substantially said one end thereof to a point short of the other end of said fin; each said structural line of weakness including a small, uncut, and substantially unweakened, segment of carton material at said one end of said fin, such that, when said easily removable section is removed, opening said carton, the tearing away of said unweakened segment leaves a ragged tit on the top of the pouring spout.

18. A carton as in claim 17 wherein said top wall has a pour spout on the end thereof corresponding to said one end of said carton, the combination of said pour spout and said removable section being cooperatively disposed so that, upon removal of said removable section, said spout may be opened for dispensing product.

19. A cut and scored carton blank said blank being constructed from a structural carton material having a heat sealable layer on the surface thereof which will be on the interior of the carton, said blank being susceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension remote from said side walls and said end walls; said sealing margins being joined together in the form of a fin seal, producing a fin having multiple thicknesses of said structural carton material joined together on the top of said carton, said seal having an outer edge disposed toward the outer edge of said fin and an inner edge disposed toward the interior of said carton, said carton having one end, and said fin having a corresponding end for disposition of opening means thereon; each said thickness of structural carton material having a structural line of weakness substantially on said inner edge of said seal and extending along said fin from substantially said one end thereof to a point short of the other end of said fin; each said structural line of weakness including a small, uncut, and substantially unweakened, segment of carton material at said one end of said fin where said pouring tip is to be formed when the carton is opened, such that, when said easily removable section is removed, opening the carton, the tearing away of said unweakened segment leaves a ragged tit on the tip of the spout.

20. A carton blank as in claim 19 wherein said top wall has a pour spout on the end thereof corresponding to said one end of said carton, the combination of said pour spout and said removable section being cooperatively disposed so that, upon removal of said removable section, said spout may be opened for dispensing product.

21. A liquid tight carton constructed from a structural carton material, and having a heat sealable layer on the inner surface thereof, said carton comprising: a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension panel remote from said side walls and said end walls; said sealing margins being joined together in the form of a fin seal, producing a fin having multiple thicknesses of said structural carton material joined together, said seal having an outer edge disposed toward the outer edge of said fin and an inner edge disposed toward the interior of said carton, said carton top having one end and said fin having a corresponding end for disposition of opening means thereon; each said thickness of structural carton material having a structural line of weakness substantially on said inner edge of said seal and extending along said fin from substantially said one end thereof to a point short of the other end of said fin, said sealing margin including a line of weakness extending from the outer edge of said margin to the edge of the main extension panel, said line of weakness being located adjacent the joinder between the end wall extension opposite said one end and the adjoining side wall extensions.

22. A cut and scored carton blank said blank being constructed from a structural carton material having a heat sealable layer on the surface thereof which will be on the interior of the carton, said blank being susceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension panel remote from said side walls and said end walls; said sealing margins being joined together in the form of a fin seal, producing a fin having multiple thicknesses of said structural carton material joined together on the top of said carton, said seal having an outer edge disposed toward the outer edge of said fin and an inner edge disposed toward the interior of said carton, said carton having one end, and said fin having a corresponding end for disposition of opening means thereon; each said thickness of structural carton material having a structural line of weakness substantially on said inner edge of said seal and extending along said fin from substantially said one end thereof to a point short of the other end of said fin: said sealing margin including a line of weakness extending from the outer edge of said margin to the edge of the main body of the adjoining extensions, said line of weakness being located adjacent the joinder between the end wall extension opposite said one end and the adjoining side wall extensions.

23. A carton constructed from a structural carton material, and having a heat sealable layer on the inner surface thereof, said carton comprising: a bottom wall, upstanding side walls and upstanding end walls; said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension panel remote from said side walls and said end walls; said sealing margins being joined together in the form of a fin seal, producing a fin having multiple thicknesses of said structural carton material joined together, said seal having an outer edge disposed toward the outer edge of said fin and an inner edge disposed toward the interior of said carton, said carton top having one end, and said fin having a corresponding end for disposition of opening means thereon; each said thickness of structural carton material having a structural line of weakness substantially on said inner edge of said seal and extending along said fin from substantially said one end thereof to a point short of the other end of said fin; said margins comprising said fin having opening tabs connected thereto on said one end of said fin; said structural line of weakness on each said thickness of structural carton material being disposed between said opening tab and said margin, said opening tabs being joined to each other, and comprising said easily removable section of the top panel; said sealing margins on said one end of said fin being substantially free of seals between one another; the top of said carton having a substantially continuous seal along the entire length thereof.

24. A cut and scored carton blank, said blank being constructed from a structural carton material having a heat sealable layer on the surface thereof which will be on the interior of the carton, said blank being susceptible of being erected into a carton comprising a bottom wall, upstanding side walls and upstanding end walls, said side walls and end walls connected to the edges of said bottom wall and to each other to form a receptacle; and a top wall connected to said side walls and said end walls; said top wall comprising extensions of said side walls and said end walls; said extensions being joined together and comprising main extension panels joined to said side walls and said end walls, and sealing margins on the edge of each said extension panel remote from said side walls and said end walls; said sealing margins being joined together in the form of a fin seal, producing a fin having multiple thicknesses of said structural carton material joined together on the top of said carton, said seal having an outer edge disposed toward the outer edge of said fin and an inner edge disposed toward the interior of said carton, said carton top having one end, and said fin having a corresponding end for disposition of opening means thereon; each said thickness of structural carton material having a structural line of weakness substantially on said inner edge of said seal and extending along said fin from substantially said one end thereof to a point short of the other end of said fin; said margins comprising said fin having opening tabs connected thereto on said one end of said fin; said structural line of weakness on each said thickness of structural carton material being disposed between said opening tab and said margin, said opening tabs being joined to each other, and comprising said easily removable section of the top panel; said sealing margins on said one end of said fin being substantially free of seals between one another, the top of said carton having a substantially continuous seal along the entire length thereof.

* * * * *